US010435772B2

(12) United States Patent
Ishida et al.

(10) Patent No.: US 10,435,772 B2
(45) Date of Patent: Oct. 8, 2019

(54) STEEL SHEET

(71) Applicant: NIPPON STEEL & SUMITOMO METAL CORPORATION, Tokyo (JP)

(72) Inventors: Yoshinari Ishida, Tokyo (JP); Riki Okamoto, Tokyo (JP); Daisuke Maeda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 254 days.

(21) Appl. No.: 15/546,410

(22) PCT Filed: Mar. 28, 2016

(86) PCT No.: PCT/JP2016/059933
§ 371 (c)(1),
(2) Date: Jul. 26, 2017

(87) PCT Pub. No.: WO2016/158861
PCT Pub. Date: Oct. 6, 2016

(65) Prior Publication Data

US 2018/0023172 A1 Jan. 25, 2018

(30) Foreign Application Priority Data

Mar. 27, 2015 (JP) ..... 2015-067699

(51) Int. Cl.
*C22C 38/28* (2006.01)
*B21B 3/02* (2006.01)
(Continued)

(52) U.S. Cl.
CPC ..... *C22C 38/28* (2013.01); *B21B 3/02* (2013.01); *B21C 37/02* (2013.01); *C21D 8/02* (2013.01);
(Continued)

(58) Field of Classification Search
CPC ..... C22C 38/00; C22C 38/001; C22C 38/002; C22C 38/005; C22C 38/02; C22C 38/04;
(Continued)

(56) References Cited

U.S. PATENT DOCUMENTS

2015/0056468 A1 2/2015 Kizu et al.

FOREIGN PATENT DOCUMENTS

JP 7-34137 A 2/1995
JP 7-118792 A 5/1995
(Continued)

OTHER PUBLICATIONS

International Preliminary Report on Patentability and English translation of the Written Opinion of the International Searching Authority (Forms PCT/IB/338, PCT/IB/373, and PCT/ISA/237) for International Application No. PCT/JP2016/059933, dated Oct. 12, 2017.
(Continued)

*Primary Examiner* — Alexandra M Moore
(74) *Attorney, Agent, or Firm* — Birch, Stewart, Kolasch & Birch, LLP

(57) ABSTRACT

A steel sheet includes: a base iron; a scale of 10.0 μm or less in thickness on a surface of the base iron; a subscale between the base iron and the scale. In the subscale, an average value of Cr concentrations is 1.50 mass % to 5.00 mass %, and one part or more exist(s) where a ratio of Cr concentrations between two adjacent measurement regions separate by 1 μm is 0.90 or less or 1.11 or more in a range of 50 μm in length in a rolling direction. A percentage of an amount of Ti contained in carbide or carbonitride of 100 nm or more and 1 μm or less in grain diameter to a parameter $Ti_{eff}$ represented by a formula "$Ti_{eff}$=[Ti]−48/14[N]" is 30% or less in which [Ti] denotes a Ti content (mass %) and [N] denotes a N content (mass %).

4 Claims, 2 Drawing Sheets

(51) Int. Cl.

| | |
|---|---|
| ***B21C 37/02*** | (2006.01) |
| ***C21D 8/02*** | (2006.01) |
| ***C21D 9/46*** | (2006.01) |
| ***C22C 38/00*** | (2006.01) |
| ***C22C 38/58*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/42*** | (2006.01) |
| ***C22C 38/50*** | (2006.01) |
| ***C22C 38/38*** | (2006.01) |

(52) U.S. Cl.

CPC ..... *C21D 8/0205* (2013.01); *C21D 8/0226* (2013.01); *C21D 9/46* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/38* (2013.01); *C22C 38/42* (2013.01); *C22C 38/50* (2013.01); *C22C 38/58* (2013.01)

(58) Field of Classification Search

CPC ..... C22C 38/06; C22C 38/22; C22C 38/24; C22C 38/26; C22C 38/28; C22C 38/38; C22C 38/42; C22C 38/50; C22C 38/58; C21D 8/00; C21D 8/02; C21D 8/0205; C21D 8/0226; C21D 9/46; B21B 1/00; B21B 3/00; B21B 2261/14; B21C 1/00; B21C 37/00; B21D 53/04

See application file for complete search history.

(56) References Cited

FOREIGN PATENT DOCUMENTS

| | | | |
|---|---|---|---|
| JP | 10-36939 | A | 2/1998 |
| JP | 11-71637 | A | 3/1999 |
| JP | 11-343536 | A | 12/1999 |
| JP | 2000-45041 | A | 2/2000 |
| JP | 2000-87185 | A | 3/2000 |
| JP | 3113490 | B2 | 11/2000 |
| JP | 2004-244680 | A | 9/2004 |
| JP | 2004-346416 | A | 12/2004 |
| JP | 2010-24547 | A | 2/2010 |
| JP | 2012-162778 | A | 8/2012 |
| JP | 2014-4610 | A | 1/2014 |
| JP | 2014-31537 | A | 2/2014 |
| JP | 2014-51683 | A | 3/2014 |
| JP | 5459028 | B2 | 4/2014 |
| JP | 2014-118592 | A | 6/2014 |
| JP | 2014-185352 | A | 10/2014 |
| TW | 201343931 | A | 11/2013 |

OTHER PUBLICATIONS

International Search Report for PCT/JP2016/059933 dated Jun. 21, 2016.

Takeda et al., "Influence of Cr Content and Heating Conditions on the Microstructure and Adhesion of Scales in Cr Steels", Kobe Steel Engineering Reports, Dec. 2006, vol. 56, No. 3, pp. 22-25.

Written Opinion of the International Searching Authority for PCT/JP2016/059933 (PCT/ISA/237) dated Jun. 21, 2016.

Extended European Search Report dated Aug. 29, 2018 for Application No. 16772742.9.

STEEL SHEET

TECHNICAL FIELD

The present invention relates to a high-strength steel sheet suitable for a comparatively long structural member such as a frame of a truck.

BACKGROUND ART

Weight reduction of transportation machines such as an automobile and a railway vehicle is desired in order to curtail exhaust gas by improvement of fuel consumption. Though usage of a thin steel sheet for a member of the transportation machine is effective in reducing weight of the transportation machine, it is desired that the steel sheet itself has high strength in order to secure desired strength while using the thin steel sheet.

For a member of a transportation machine such as a side frame of a truck, a steel sheet in which a scale (black scale) generated during hot rolling remains is sometimes used in view of a cost or the like. However, in a conventional steel sheet in which a scale remains, the scale may exfoliate in finishing such as passing in leveler equipment or working such as bending and pressing carried out by a user. Exfoliation of a scale necessitates care for a roll or a mold to which the scale attaches. Further, when the scale remains after the care, the scale may be pushed into a steel sheet processed thereafter, to generate a depression pattern in the steel sheet. Therefore, excellent scale adhesion is required of a steel sheet in which a scale remains in order to suppress exfoliation of the scale from a base iron.

Though a steel sheet aiming at improvement of scale adhesion is known, a conventional steel sheet cannot achieve both good mechanical property and excellent scale adhesion.

CITATION LIST

Patent Literature

Patent Literature 1: Japanese Laid-open Patent Publication No. 2014-31537

Patent Literature 2: Japanese Laid-open Patent Publication No. 2012-162778

Patent Literature 3: Japanese Patent No. 5459028

Patent Literature 4: Japanese Laid-open Patent Publication No. 2004-244680

Patent Literature 5: Japanese Laid-open Patent Publication No. 2000-87185

Patent Literature 6: Japanese Laid-open Patent Publication No. 7-34137

Patent Literature 7: Japanese Laid-open Patent Publication No. 2014-51683

Patent Literature 8: Japanese Laid-open Patent Publication No. 7-118792

Patent Literature 9: Japanese Laid-open Patent Publication No. 2014-118592

Non-Patent Literature

Non-Patent Literature 1: Kobe Steel Engineering Reports Vol. 56 No. 32 No. 3 (December 2006) P. 22

SUMMARY OF THE INVENTION

Technical Problem

An object of the present invention is to provide a steel sheet capable of achieving both good mechanical property and excellent scale adhesion.

Solution to Problem

The present inventors conducted keen study in order to solve the above-described problem. Consequently, it has become obvious that forms of a scale and a subscale substantially affect improvement of scale adhesion. Further, it has also become obvious that the forms of the scale and the subscale are affected by a condition of hot rolling in particular.

The present inventors further conducted keen study based on the above observation and reached modes of the invention described below.

(1) A steel sheet including:

a base iron;

a scale of 10.0 μm or less in thickness on a surface of the base iron; and a subscale between the base iron and the scale, wherein the base iron comprises a chemical composition represented by, in mass %, C: 0.05% to 0.20%,
Si: 0.01% to 1.50%,
Mn: 1.50% to 2.50%,
P: 0.05% or less,
S: 0.03% or less,
Al: 0.005% to 0.10%,
N: 0.008% or less,
Cr: 0.30% to 1.00%,
Ti: 0.06% to 0.20%,
Nb: 0.00% to 0.10%,
V: 0.00% to 0.20%,
B: 0.0000% to 0.0050%,
Cu: 0.00% to 0.50%,
Ni: 0.00% to 0.50%,
Mo: 0.00% to 0.50%,
W: 0.00% to 0.50%,
Ca: 0.0000% to 0.0050%,
Mg: 0.0000% to 0.0050%,
REM: 0.000% to 0.010%, and
the balance: Fe and impurities, wherein, in the subscale, an average value of Cr concentrations is 1.50 mass % to 5.00 mass %, and one part or more exist(s) where a ratio of Cr concentrations between two adjacent measurement regions separate by 1 μm is 0.90 or less or 1.11 or more in a range of 50 μm in length in a rolling direction, and wherein a percentage of an amount of Ti contained in carbide or carbonitride of 100 nm or more and 1 μm or less in grain diameter to a parameter $Ti_{eff}$ represented by a following formula 1 is 30% or less, [Ti] denoting a Ti content (mass %) and [N] denoting a N content (mass %) in the following formula 1, $$Ti_{eff}=[Ti]-48/14[N] \quad \text{(formula 1).}$$

(2) The steel sheet according to (1), wherein, in the chemical composition,

Nb: 0.001% to 0.10%,
V: 0.001% to 0.20%,
B: 0.0001% to 0.0050%,

Cu: 0.01% to 0.50%,
Ni: 0.01% to 0.50%,
Mo: 0.01% to 0.50%, or
W: 0.01% to 0.50%,
or any combination thereof is satisfied.

(3) The steel sheet according to (1) or (2), wherein, in the chemical composition,
Ca: 0.0005% to 0.0050%,
Mg: 0.0005% to 0.0050%, or
REM: 0.0005% to 0.010%,
or any combination thereof is satisfied.

Advantageous Effects of Invention

According to the present invention, both good mechanical property and excellent scale adhesion can be achieved, since forms of a scale and a subscale are appropriate.

DESCRIPTION OF EMBODIMENTS

The present inventors studied influence of a thickness of a scale and a form of a subscale upon scale adhesion.

In measuring the thicknesses of the scales, samples in which surfaces parallel to a rolling direction and a thickness direction were observation surfaces were taken from various steel sheets, the observation surfaces were mirror polished, and observation by using an optical microscope was carried out at a magnification of 1000 times. Then, an average value of the thicknesses of the scales obtained in 10 or more visual fields was defined as the thickness of the scale of the steel sheet.

In analysis of the form of the subscale, samples in which surfaces parallel to the rolling direction and the thickness direction were observation surfaces were taken from various steel sheets, the observation surfaces were mirror polished, and Cr concentrations (mass %) of the subscales were analyzed by using an electron probe micro analyzer (EPMA). Concretely, mapping of the Cr concentrations was carried out in a region which includes the scale and the base iron in 50 μm or more in length in the rolling direction, at an acceleration voltage of 15.0 kV and at an irradiation current of 50 nA, with a measurement time per point being 20 msec. In this mapping, an interval between measurement points was set to 0.1 μm in both the rolling direction and the thickness direction.

Figure 1:
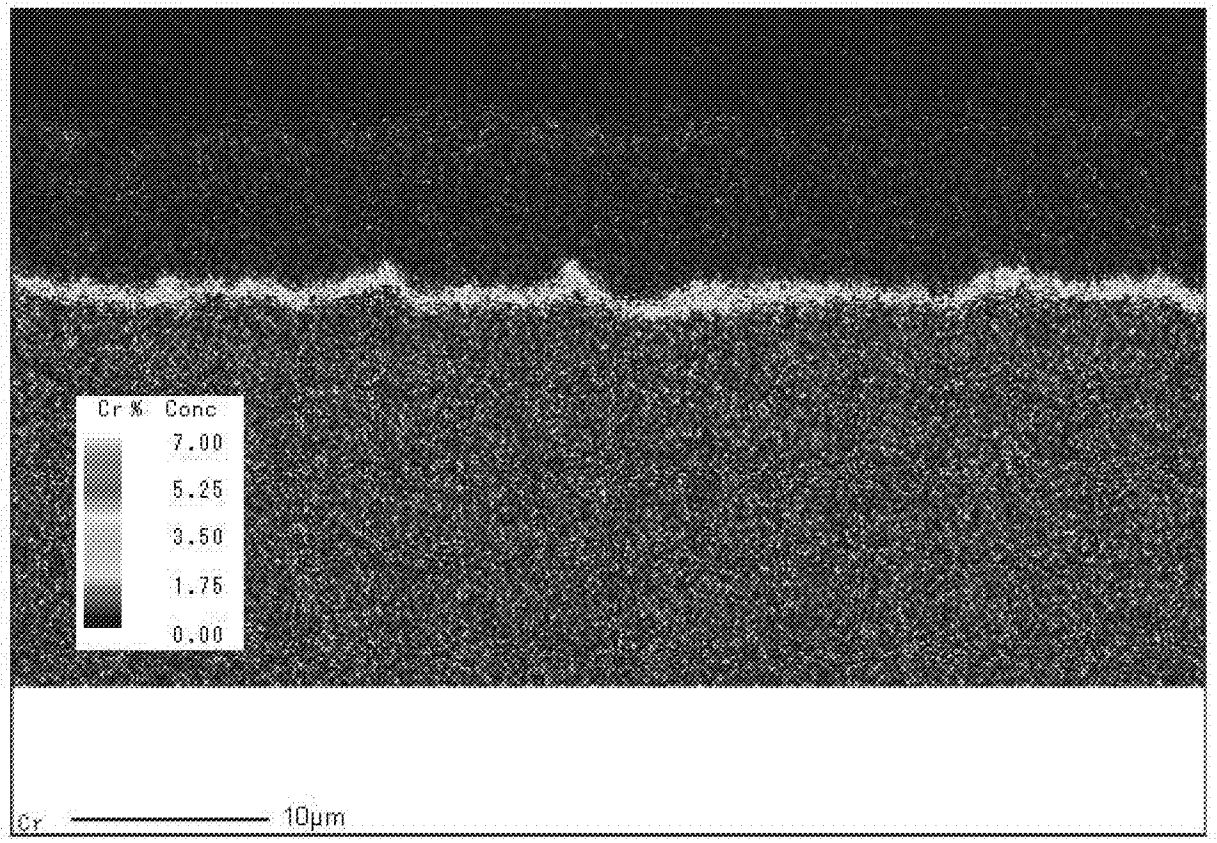
FIG. 1 is a chart illustrating an example of a result of Cr concentration mapping.

FIG. 1 illustrates an example of a result of the mapping. A Cr content of the base iron of the sample used in this example was 3.9 mass %, and an analysis object was a region whose length in a rolling direction was 60 μm and which included the scale and the base iron. In FIG. 1, a part in which the Cr concentration is particularly high is a subscale, a part thereunder is the base iron and a part thereabove is the scale. As is obvious from FIG. 1, the Cr concentration of the subscale is higher than that of the base iron.

The present inventors carried out following analysis about the result of the mapping of the Cr concentrations. In this analysis, a measurement region was defined as a region made of 10 measurement points continually lining up in the rolling direction. Since an interval between the measurement points was 0.1 μm, a dimension in the rolling direction of the measurement region was 1 μm. Further, since a length in the rolling direction of an object region of the mapping of the Cr concentrations was 50 μm or more, there were 50 or more measurement regions. An average value and a maximum value Cmax of the Cr concentrations were found for every measurement region, an average value Ave of the maximum values Cmax among the 50 or more measurement regions were calculated, and the average value Ave was defined as an average value of the Cr concentrations in the subscale.

Further, regarding the 50 or more measurement regions, a concentration ratio $R_{Cr}$ of one maximum value Cmax to the other maximum value Cmax between the two adjacent measurement regions was found. In other words, a quotient obtained as a result of dividing one maximum value Cmax by the other maximum value Cmax was found. At this time, either one of the maximum values Cmax was arbitrarily chosen as a numerator. For example, in a case where the maximum value Cmax of the two measurement regions are 3.90% and 3.30%, the concentration ratio $R_{Cr}$ is 1.18 or 0.85 and in a case where the maximum values Cmax of the two measurement regions are 1.70% and 1.62%, the concentration ratio $R_{Cr}$ is 1.05 or 0.95. Further, in a case where the maximum values Cmax of the two measurement regions are equal, the concentration ratio $R_{Cr}$ is 1.00, and if the maximum values Cmax of the Cr concentrations in the subscale are uniform, the concentration ratio $R_{Cr}$ is 1.00 in any measurement region. As described above, the concentration ratio $R_{Cr}$ reflects variation of the maxim values Cmax of the Cr concentrations in the subscale, and as the concentration ratio $R_{Cr}$ is closer to 1.00, the variation of the maximum values Cmax of the Cr concentrations in the subscale is small.

The scale adhesion was evaluated by taking a strip test piece in a manner that a longitudinal direction was parallel to a width direction of the steel sheet, assuming press working of a side frame of a truck, by a V-block method described in JIS Z2248. A size of the test piece was 30 mm in width (rolling direction) and 200 mm in length (width direction). A bending angle was set to 90 degrees and an inside radius was set to two times a sheet thickness.

After bending, adhesive cellophane tape of 18 mm in width was applied in a width center part of bend outside along the longitudinal direction of the test piece and then peeled, and an area ratio of a scale attached to the adhesive cellophane tape was calculated in a region where the steel sheet and a V-block were not in contact.

The test piece with the area ratio of the scale attached to the adhesive cellophane tape, that is, the area ratio of the scale exfoliated from the steel sheet, was 10% or less was judged good and one with the area ratio of over 10% was judged bad. The present inventors made sure that when the area ratio of the scale exfoliated from the steel sheet is 10% or less in this experiment, exfoliation in a processing in practical use does not substantially occur.

Relation between the thickness of the scale and the scale adhesion was sorted out and it was found that when the thickness of the scale exceeded 10.0 μm, good scale adhesion was not able to be obtained regardless of the Cr concentration of the scale. Meanwhile, when the thickness of the scale was 10.0 μm or less, good scale adhesion was sometimes able to be obtained or not obtained, depending on the form of the subscale.

Figure 2:
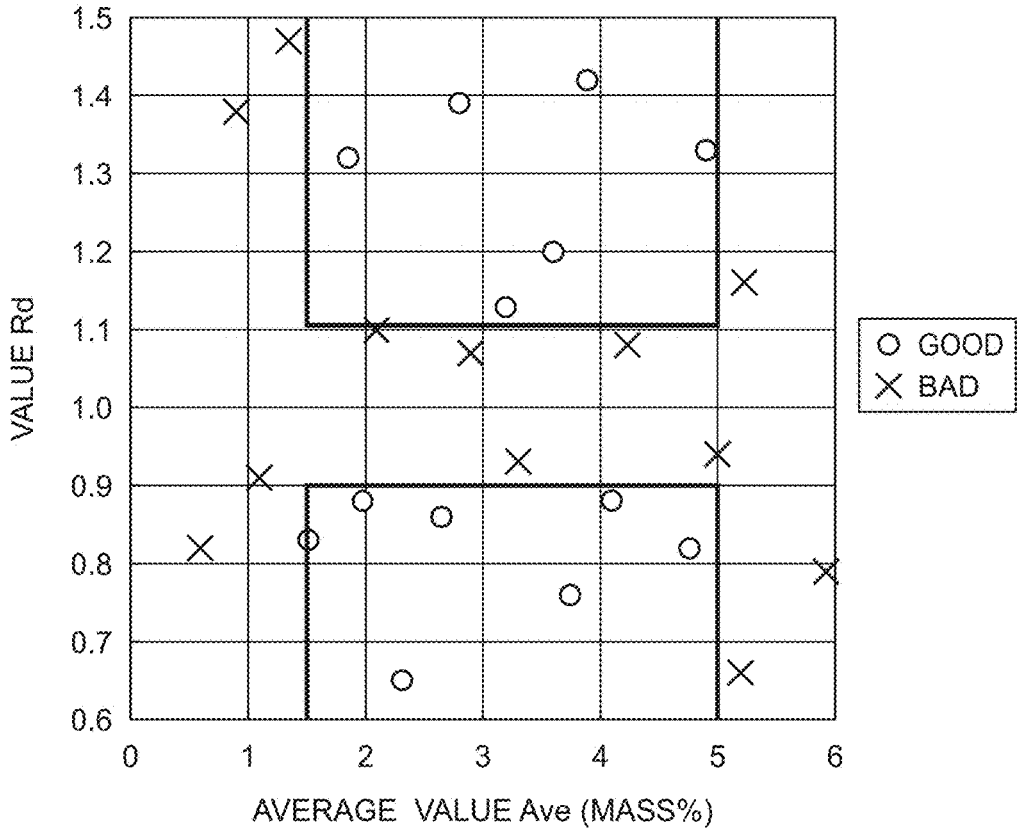
FIG. 2 is a chart illustrating a relation between form of scale and scale adhesion.

Thus, regarding the steel sheet of 10.0 μm or less in thickness of the scale, the present inventors sorted out relation between an average Ave of the Cr concentrations as well as a value Rd, which is the farthest value from 1.00 among concentration ratios $R_{Cr}$, and the scale adhesion. FIG. 2 illustrates the result. A horizontal axis in FIG. 2 indicates the average value Ave of the Cr concentrations and a vertical axis indicates the value Rd, which is the farthest value from 1.00 among the concentration ratios $R_{Cr}$.

As illustrated in FIG. 2, in the sample in which the average value Ave of the Cr concentrations was less than 1.50 mass % or over 5.00 mass %, the scale adhesion was bad. Further, in the sample in which the value Rd, which is the farthest value from 1.00 among the concentration ratios $R_{Cr}$, is over 0.90 and less than 1.11, the scale adhesion was bad even if the average value Ave of the Cr concentrations was 1.50 mass % to 5.00 mass %.

From the above, it became obvious that, as for subscale, it is important that the average value Ave of the Cr concentrations is 1.50 mass % to 5.00 mass % and that one part or more exist(s) where a concentration ratio(s) $R_{Cr}$ between two adjacent measurement regions separate by 1 μm is 0.90 or less or 1.11 or more in a range of 50 μm in length in the rolling direction in order to obtain excellent scale adhesion.

Further, as a mechanical property suitable for application to a side frame of a truck, there may be cited that a yield strength in the rolling direction is 700 MPa or more and less than 800 MPa and that a yield ratio is 85% or more, and in order to achieve the above, precipitation strengthening by carbide containing Ti and carbonitride containing Ti with a grain diameter of less than 100 nm is quite effective. Hereinafter, the carbide containing Ti and the carbonitride containing Ti may be collectively referred to as Ti carbide.

Hereinafter, an embodiment of the present invention will be described.

First, a chemical composition of a steel sheet according to the embodiment of the present invention and a steel used for manufacturing thereof will be described. Details being described later, the steel sheet according to the embodiment of the present invention is manufactured through casting of the steel, slab heating, hot rolling, first cooling, coiling, and second cooling. Therefore, the chemical composition of the steel sheet and the steel is one in consideration of not only a property of the steel sheet but also the above processing. In the following explanation, "%" being a unit of a content of each element contained in the steel sheet and the steel means "mass %" as long as not otherwise specified. The steel sheet according to the embodiment and the steel used for manufacturing thereof have a chemical composition represented by, in mass %, C: 0.05% to 0.20%, Si: 0.01% to 1.50%, Mn: 1.50% to 2.50%, P: 0.05% or less, S: 0.03% or less, Al: 0.005% to 0.10%, N: 0.008% or less, Cr: 0.30% to 1.00%, Ti: 0.06% to 0.20%, Nb: 0.00% to 0.10%, V: 0.00% to 0.20%, B: 0.0000% to 0.0050%, Cu: 0.00% to 0.50%-Ni: 0.00% to 0.50%, Mo: 0.00% to 0.50%, W: 0.00% to 0.50%, Ca: 0.0000% to 0.0050%, Mg: 0.0000% to 0.0050%, REM: 0.000% to 0.010%, and the balance: Fe and impurities. As the impurities, ones included in a raw materials, such as ore and scrap, and ones included in a manufacturing process are exemplified. Sn and As may be cited as examples of the impurities.

(C: 0.05% to 0.20%)

C contributes to improvement of strength. A C content of less than 0.05% cannot attain sufficient strength, for example, yield strength of 700 MPa or more in the rolling direction or a yield ratio of 85% or more, or both thereof. Therefore, the C content is 0.05% or more and preferably 0.08% or more. Meanwhile, a C content of over 0.20% brings about excessive strength, to reduce ductility or to reduce weldability and toughness. Therefore, the C content is 0.20% or less, preferably 0.15% or less, and more preferably 0.14% or less.

(Si: 0.01% to 1.50%)

Si contributes to improvement of strength and acts as a deoxidizer. Si also contributes to improvement of a shape of a welded part in arc welding. A Si content of less than 0.01% cannot attain such effects sufficiently. Therefore, the Si content is 0.01% or more, and preferably 0.02% or more. Meanwhile, a Si content of over 1.50% makes a large amount of Si scales occur in a surface of a steel sheet so as to deteriorate a surface property, or reduces toughness. Therefore, the Si content is 1.50% or less and preferably 1.20% or less. When the Si content is 1.50% or less, influence of Si to scale adhesion can be ignored in the present embodiment.

(Mn: 1.50% to 2.50%)

Mn contributes to improvement of strength through strengthening of a structure. A Mn content of less than 1.50% cannot attain such an effect sufficiently. For example, it is impossible to obtain yield strength of 700 MPa or more in the rolling direction or a yield ratio of 85%, or both thereof. Therefore, the Mn content is 1.50% or more and preferably 1.60% or more. Meanwhile, a Mn content of over 2.50% brings about excessive strength so as to reduce ductility, or reduces weldability and toughness. Therefore, the Mn content is 2.50% or less, preferably 2.40% or less, and more preferably 2.30% or less.

(P: 0.05% or Less)

P is not an essential element, and is contained in steel as an impurity, for example. Since P deteriorates ductility and toughness, a P content is better as low as possible. In particular, a P content of over 0.05% notably reduces ductility and toughness. Therefore, the P content is 0.05% or less, preferably 0.04% or less, and more preferably 0.03% or less. It is costly to decrease the P content, and in order to decrease the P content to less than 0.0005%, a cost increases notably. Thus, the P content may be 0.0005% or more, and may be 0.0010% or more in view of the cost.

(S: 0.03% or Less)

S is not an essential element, and is contained in steel as an impurity, for example. Since S generates MnS and deteriorates ductility, weldability, and toughness, an S content is better as low as possible. In particular, the S content of over 0.03% notably reduces ductility, weldability, and toughness. Therefore, the S content is 0.03% or less, preferably 0.01% or less, and more preferably 0.007% or less. It is costly to decrease the S content, and in order to decrease the S content to less than 0.0005%, a cost increases notably. Thus, the S content may be 0.0005% or more, and may be 0.0010% or more in view of the cost.

(Al: 0.005% to 0.10%)

Al acts as a deoxidizer. An Al content of less than 0.005% cannot attain such an effect. Therefore, the Al content is 0.005% or more and preferably 0.015% or more. Meanwhile, an Al content of over 0.10% reduces toughness and weldability. Therefore, the Al content is 0.10% or less and preferably 0.08% or less.

(N: 0.008% or Less)

N is not an essential element, and is contained in steel as an impurity, for example. N forms TiN and consumes Ti so as to impede generation of fine Ti carbide suitable for precipitation strengthening. Thus, the N content is better as low as possible. In particular, the N content of over 0.008% notably reduces precipitation strengthening capability. Therefore, the N content is 0.008% or less and preferably 0.007% or less. It is costly to decrease the N content, and in order to decrease the N content to less than 0.0005%, a cost increases notably. Thus, the N content may be 0.0005% or more, and may be 0.0010% or more in view of the cost.

(Cr: 0.30% to 1.00%)

Cr contributes to improvement of strength and increases scale adhesion through formation of a subscale. A Cr content of less than 0.30% cannot attain such effects. Therefore, the Cr content is 0.30% or more and preferably 0.25% or more. Meanwhile, if the Cr content is over 1.00%, Cr contained in the subscale becomes excessive, resulting in that the scale adhesion is reduced. Therefore, the Cr content is 1.00% or less and preferably 0.80% or less.

(Ti: 0.06% to 0.20%)

Ti contributes to improvement of yield strength by suppressing recrystallization to thereby suppress coarsening of a grain, and contributes to improvement of yield strength and a yield ratio through precipitation strengthening by precipitating as Ti carbide. A Ti content of less than 0.06% cannot attain such effects sufficiently. Therefore, the Ti content is 0.06% or more and preferably 0.07% or more. Meanwhile, a Ti content of over 0.20% reduces toughness, weldability, and ductility, or makes Ti carbide not able to be solid-solved sufficiently during slab heating, resulting in shortage of an amount of Ti effective for precipitation strengthening, to cause reduction of the yield strength and the yield ratio. Therefore, the Ti content is 0.20% or less and preferably 0.16% or less.

Nb, V, B, Cu, Ni, Mo, W, Ca, Mg, and REM are not essential elements but are arbitrary elements which may be appropriately contained in a steel sheet and steel to the extent of a specific amount.

(Nb: 0.00% to 0.10%, V: 0.00% to 0.20%)

Nb and V precipitate as carbonitride to thereby contribute to improvement of strength, or contribute to suppression of coarsening of a grain. Suppression of coarsening of the grain contributes to improvement of yield strength and improvement of toughness. Therefore, Nb or V, or both thereof may be contained. In order to obtain such effects sufficiently, a Nb content is preferably 0.001% or more and more preferably 0.010% or more, and a V content is preferably 0.001% or more and more preferably 0.010% or more. Meanwhile, a Nb content of over 0.10% reduces toughness and ductility, to make Nb carbonitride not able to be solid-solved sufficiently during slab heating, resulting in shortage of solid-solution C effective for securing strength, to cause reduction of the yield strength and the yield ratio. Therefore, the Nb content is 0.10% or less and preferably 0.08% or less. A V content of over 0.2% reduces toughness and ductility. Therefore, the V content is 0.20% or less and preferably 0.16% or less.

(B: 0.0000% to 0.0050%)

B contributes to improvement of strength through strengthening of a structure. Therefore, B may be contained. In order to obtain such an effect sufficiently, a B content is preferably 0.0001% or more and more preferably 0.0005% or more. Meanwhile, a B content of over 0.0050% reduces toughness or saturates an improvement effect of strength. Therefore, the B content is 0.0050% or less and preferably 0.0030% or less.

(Cu: 0.00% to 0.50%)

Cu contributes to improvement of strength. Therefore, Cu may be contained. In order to obtain such an effect sufficiently, a Cu content is preferably 0.01% or more and more preferably 0.03% or more. Meanwhile, a Cu content of over 0.50% reduces toughness and weldability, or increases apprehension of a hot tear of slab. Therefore, the Cu content is 0.50% or less and preferably 0.30% or less.

(Ni: 0.00% to 0.50%)

Ni contributes to improvement of strength or contributes to improvement of toughness and suppression of a hot tear of slab. Therefore, Ni may be contained. In order to obtain such effects sufficiently, a Ni content is preferably 0.01% or more and more preferably 0.03% or more. Meanwhile, a Ni content of over 0.50% unnecessarily increases a cost. Therefore, the Ni content is 0.50% or less and preferably 0.30% or less.

(Mo: 0.00% to 0.50%, W: 0.00% to 0.50%)

Mo and W contribute to improvement of strength. Therefore, Mo or W, or both thereof may be contained. In order to obtain such effects sufficiently, a Mo content is preferably 0.01% or more and more preferably 0.03% or more, and a W content is preferably 0.01% or more and more preferably 0.03% or more. Meanwhile, a Mo content of over 0.50% unnecessarily increases a cost. Therefore, the Mo content is 0.50% or less and preferably 0.35% or less. A W content of over 0.50% unnecessarily increases a cost. Therefore, the W content is 0.50% or less and preferably 0.35% or less.

From the above, regarding Nb, V, B, Cu, Ni, Mo, and W, it is preferable that "Nb: 0.001% to 0.10%", "V: 0.001% to 0.20%", "B: 0.0001% to 0.0050%", "Cu: 0.01% to 0.50%", "Ni: 0.01% to 0.50%", "Mo: 0.01% to 0.50%", or "W: 0.01% to 0.50%", or any combination thereof is satisfied.

(Ca: 0.0000% to 0.0050%, Mg: 0.0000% to 0.0050%, REM: 0.000% to 0.010%)

Ca, Mg, and REM contribute to improvement of toughness and suppression of reduction of ductility by spheroidizing a non-metal inclusion. Therefore, Ca, Mg, or REM, or any combination thereof may be contained. In order to obtain such effects sufficiently, a Ca content is preferably 0.0005% or more and more preferably 0.0010% or more, an Mg content is preferably 0.0005% or more and more preferably 0.0010% or more, and a REM content is preferably 0.0005% or more and more preferably 0.0010% or more. Meanwhile, a Ca content of over 0.0050% prominently coarsens the inclusion and increases the number of the inclusions, to reduce toughness. Therefore, the Ca content is 0.0050% or less and preferably 0.0035% or less. A Mg content of over 0.0050% prominently coarsens the inclusion and increases the number of the inclusions, to reduce toughness. Therefore, the Mg content is 0.0050% or less and preferably 0.0035% or less. A REM content of over 0.010% prominently coarsens the inclusion and increases the number of the inclusions, to reduce toughness. Therefore, the REM content is 0.010% or less and preferably 0.007% or less.

From the above, regarding Ca, Mg, and REM, it is preferable that "Ca: 0.0005% to 0.0050%", "Mg: 0.0005% to 0.0050%", or "REM: 0.0005% to 0.010%", or any combination thereof is satisfied.

REM (rare earth metal) indicates elements of 17 kinds in total of Sc, Y, and lanthanoid, and a "REM content" means a total content of these elements of 17 kinds. Lanthanoid is industrially added as a form of misch metal, for example.

Next, form of Ti in the steel sheet according to the embodiment of the present invention will be described. In the steel sheet according to the embodiment of the present invention, when [Ti] denotes a Ti content (mass %) and [N] denotes a N content (mass %), a ratio $R_{Ti}$ of an amount (mass %) of Ti contained in Ti carbide of 100 nm or more and 1 μm or less in grain diameter to a parameter $Ti_{eff}$(effective Ti amount) represented by the following formula 1 is 30% or less.

$$Ti_{eff}=[Ti]-48/14[N] \quad \text{(formula 1).}$$

While Ti carbide contributes to improvement of yield stress and a yield ratio through precipitation strengthening, an amount of Ti contained in Ti carbide whose grain diameter is 100 nm or more, particularly 100 μm or more and 1 μm or less in relation to an effective Ti amount, largely influences formation of fine Ti carbide in coiling. A ratio $R_{Ti}$ of over 30% makes consumption of Ti by coarse Ti carbide excessive, and as a result that driving force to formation of the fine Ti carbide in coiling is reduced, it is impossible to obtain sufficient yield strength and yield ratio in the rolling direction. Therefore, the ratio $R_{Ti}$ is 30% or less.

A method of measurement of precipitated Ti is not limited as long as highly accurate measurement is possible. For example, precipitated Ti can be calculated as a result of carrying out random observation until at least 50 precipitates are observed with a transmission electron microscope, deriving a size distribution of the precipitates from a size of the individual precipitate and a size of the whole visual field, and obtaining a Ti concentration in the precipitate by means of energy dispersive X-ray spectroscopy (EDS).

Next, forms of a scale and a subscale in the steel sheet according to the embodiment of the present invention will be described. In the steel sheet according to the embodiment of the present invention, the thickness of the scale is 10.0 μm or less, and in the subscale, the average value Ave of the Cr concentrations is 1.50 mass % to 5.00 mass % and one part or more exist(s) where the concentration ratio $R_{Cr}$ between two adjacent measurement regions separate by 1 μm is 0.90 or less or 1.11 or more in a range of 50 μm in length in a rolling direction.

(Thickness of Scale: 10.0 μm or Less)

As the scale is thicker, distortion occurring in the scale during a processing of the steel sheet is larger, so that a crack occurs in the scale and that exfoliation is likely to occur. Further, as is obvious from the above-described experiment, when the thickness of the scale is over 10.0 μm, good scale adhesion cannot be obtained. Therefore, the thickness of the scale is 10.0 μm or less and preferably 8.0 μm or less.

(Average Value Ave of Cr Concentrations in Subscale: 1.50 Mass % to 5.00 Mass %)

As is obvious from a result of the above-described experiment, when the average value Ave of the Cr concentrations in the subscale is less than 1.50 mass % or over 5.00 mass %, sufficient scale adhesion cannot be obtained. Therefore, the average value Ave is 1.50 mass % to 5.00 mass %. As a reason for failure in obtaining sufficient scale adhesion in a case of the average value Ave being less than 1.50 mass %, it is considered that generation of the subscale is insufficient, to cause shortage of adhesion between the subscale and the base iron. As a reason for failure in obtaining sufficient scale adhesion in a case of the average value Ave of Cr concentrations being over 5.00 mass %, it is considered that adhesion between the subscale and the scale is reduced.

(Part where Concentration Ratio $R_{Cr}$ is 0.90 or Less or 1.11 or More: One or More)

As is obvious from the result of the above-described experiment, when the value Rd farthest from 1.00 among the concentration ratios $R_{Cr}$ is over 0.90 and less than 1.11, sufficient scale adhesion cannot be obtained. Therefore, one part or more should exist where the concentration ratio $R_{Cr}$ between two adjacent measurement regions separate by 1 μm is 0.90 or less or 1.11 or more in the range of 50 μm in length in the rolling direction. This means that a region where fluctuation of the Cr concentrations is large exists in the subscale. Though the scale contains magnetite which has good conformity to the base iron, it is considered that when the Cr concentrations are excessively uniform, contact between the magnetite and the base iron is hampered, resulting in that good scale adhesion cannot be obtained. Meanwhile, when a region where fluctuation of the Cr concentrations is large exists, it is considered that contact between the magnetite and the base iron is secured via this region thereby to enable excellent scale adhesion.

According to the present embodiment, yield strength of 700 MPa or more and less than 800 MPa in the rolling direction and a yield ratio of 85% or more in the rolling direction, for example, can be obtained. The embodiment is suitable for a long structural member such as a side frame of a truck of which high yield strength is required, and the embodiment can contribute to decrease of a vehicle weight by thinning of a sheet thickness of the member. The yield strength of 800 MPa or more may cause load necessary for press-working to be excessively large. Thus, the yield strength is preferably loss than 800 MPa. Further, the yield ratio of less than 85%, where tensile strength is too large in relation to yield stress, may cause processing to be difficult. Thus, the yield ratio is preferably 85% or more and more preferably 90% or more.

The yield strength and the yield ratio may be measured by a tensile test in accordance with JIS Z2241 at a room temperature. A JIS No. 5 tensile test piece whose longitudinal direction is a rolling direction is used as a test piece. If a yield point exists, strength of the upper yield point is defined as the yield strength, and if the yield point does not exist, 0.2% proof strength is defined as yield strength. The yield ratio is a quotient obtained by dividing yield strength by tensile strength.

Next, a manufacturing method of the steel sheet according to the embodiment of the present invention will be described. In the manufacturing method of the steel sheet according to the embodiment of the present invention, casting of steel having the above-described chemical composition, slab heating, hot rolling, first cooling, coiling, and second cooling are carried out in this order.

(Casting)

Molten steel having the above-described chemical composition is casted by a conventional method to thereby manufacture a slab. As the slab, one obtained by forging or rolling a steel ingot may be used, but it is preferable that the slab is manufactured by continuous casting. The slab manufactured by a thin slab caster or the like may be used.

(Slab Heating)

After manufacturing the slab, the slab is once cooled or left as it is and heated to a temperature of 1150° C. or higher and lower than 1250° C. If this temperature (slab heating temperature) is lower than 1150° C., precipitates containing Ti in the slab are not sufficiently solid-solved and later Ti carbonate does not precipitate sufficiently, so that sufficient strength cannot obtained. Therefore, the slab heating temperature is 1150° C. or higher and preferably 1160° C. or higher. Meanwhile, if the slab heating temperature is 1250° C. or higher, a grain becomes coarse to reduce yield stress, a generation amount of a primary scale generated in a heating furnace increases to reduce a yield, or a fuel cost increases. Therefore, the slab heating temperature is lower than 1250° C. and preferably 1245° C. or lower.

(Hot Rolling)

After the slab heating, descaling of the slab is carried out, and rough rolling is carried out. A rough bar is obtained by the rough rolling. A condition of the rough rolling is not particularly limited. After the rough rolling, finish rolling of the rough bar is carried out by using a tandem rolling mill to thereby obtain a hot-rolled steel sheet. It is preferable to remove a scale generated in a surface of the rough bar by carrying out descaling by using high-pressure water between the rough rolling and the finish rolling. On an entry side of the finish rolling, a surface temperature of the rough bar is lower than 1050° C. Further, when a delivery side temperature of the finish rolling is 920° C. or higher, the thickness of the scale becomes over 10.0 μm, so that scale adhesion is reduced. Therefore, the delivery side temperature is lower than 920° C.

A grain of the steel sheet is finer as the delivery side temperature is lower, so that excellent yield strength and toughness can be obtained. Thus, in view of a property of the steel sheet, the delivery side temperature is better as low as possible. Meanwhile, as the delivery side temperature is lower, deformation resistance of the rough bar is higher to increase a rolling load, resulting in that the finish rolling cannot be proceeded with or that control of the thickness is difficult. Therefore, it is preferable to adjust a lower limit of the delivery side temperature in correspondence with a performance of the rolling machine and accuracy of thickness control. When the delivery side temperature is lower than 800° C., progress of the finish rolling is likely to be hampered, though depending on the rolling machine. Therefore, the delivery side temperature is preferably 800° C. or higher.

(First Cooling)

Cooling of the hot-rolled steel sheet is started in a run-out-table within 3 seconds after completion of the finish rolling, and in this cooling, the temperature is lowered at an average cooling rate of over 30° C./sec between a temperature (cooling start temperature) at which the cooling is started and 750° C. When the average cooling rate between the cooling start temperature and 750° C. is 30° C./sec or less, the value Rd farthest from 1.00 among the concentration ratios $R_{Cr}$ in the two adjacent measurement regions becomes over 0.90 and less than 1.11, to uniform the Cr concentrations in the subscale, resulting in that the scale adhesion is reduced or that coarse Ti carbide is generated in an austenite phase to reduce strength. Therefore, the average cooling rate between the cooling start temperature and 750° C. is over 30° C./sec. Further, the austenite phase is likely to be recrystallized as a time from the completion of the finish rolling to the cooling start is longer, and coarse Ti carbide is formed in association with this recrystallization, resulting in that an amount of Ti effective for generation of fine Ti carbide is decreased. Further, homogenization of the Cr concentrations in the subscale progresses as the above time is longer. Besides, such a tendency is prominent when the time is over 3 seconds. Therefore, the time from the completion of the finish rolling to the cooling start is within 3 seconds.

(Coiling)

After the cooling to 750° C., the hot-rolled steel sheet is coiled at a rear end of the run-out-table. When a temperature (coiling temperature) of the hot-rolled steel sheet in coiling is 650° C. or higher, the average value Ave of the Cr concentrations in the subscale becomes excessive, resulting in that sufficient scale adhesion cannot be obtained. Therefore, the coiling temperature is lower than 650° C. and preferably 600° C. or lower. Meanwhile, a coiling temperature of 500° C. or lower makes the average value Ave of the Cr concentrations in the subscale too small, resulting in that sufficient scale adhesion cannot be obtained or that Ti carbide becomes deficient, to make it hard to obtain sufficient yield strength and yield ratio. Therefore, the coiling temperature is over 500° C. and preferably 550° C. or higher.

(Second Cooling)

After the coiling of the hot-rolled steel sheet, the hot-rolled steel sheet is cooled to the room temperature. A cooling method and a cooling rate in this cooling are not limited. From a viewpoint of a manufacturing cost, standing in cool in atmosphere is preferable.

The steel sheet according to the embodiment of the present invention can be manufactured as described above.

This steel sheet can, for example, be subjected to sheet passing through a leveler under a normal condition, formed into a flat sheet, cut into a predetermined length, and shipped as a steel sheet for a side frame of a truck, for example. The steel sheet in a form of a coil may be shipped.

Note that the aforementioned embodiments merely illustrate concrete examples of implementing the present invention and are not intended to limit the interpretation of the technical scope of the present invention. In other words, the present invention can be implemented in various manners without departing from the technical spirits or main features thereof.

EXAMPLES

Next, examples of the present invention will be described. A condition in the example is a case of condition adopted to confirm feasibility and an effect of the present invention, and the present invention is not limited to this case of the condition. In the present invention, it is possible to adopt various conditions as long as the object of the present invention is achieved without departing from the gist of the present invention.

Steels having a chemical composition presented in Table 1 were smelted, a slab was manufactured by continuous casting, and slab heating, hot rolling, first cooling, and coiling were carried out under a condition presented in Table 2. After the coiling, the steel was subjected to standing to cool to a room temperature as second cooling. The balance of the chemical composition presented in Table 1 is Fe and impurities. An underline in Table 1 indicates that the value deviates from a range of the present invention. "DELIVERY SIDE TEMPERATURE" in Table 2 is a delivery side temperature of finish rolling, "ELAPSED TIME" is an elapsed time from completion of the finish rolling till start of first cooling, "AVERAGE COOLING RATE" is an average cooling rate from a temperature at which the first cooling was started to 750° C., and "SHEET THICKNESS" is a thickness of a steel sheet after coiling.

TABLE 1

| STEEL | CHEMICAL COMPOSITION (MASS %) | | | | | | | | | |
|---|---|---|---|---|---|---|---|---|---|---|
| SYMBOL | C | Si | Mn | P | S | Al | N | Cr | Ti | Nb |
| A | 0.06 | 0.10 | 1.79 | 0.011 | 0.005 | 0.033 | 0.004 | 0.32 | 0.098 | |
| B | 0.12 | 0.23 | 2.11 | 0.020 | 0.001 | 0.020 | 0.002 | 0.70 | 0.065 | |
| C | 0.05 | 0.08 | 1.96 | 0.009 | 0.002 | 0.015 | 0.003 | 0.50 | 0.144 | |
| D | 0.11 | 0.46 | 2.38 | 0.019 | 0.003 | 0.050 | 0.005 | 0.48 | 0.070 | |
| E | 0.13 | 0.02 | 1.62 | 0.012 | 0.006 | 0.030 | 0.002 | 0.40 | 0.133 | |

TABLE 1-continued

| | | | | | | | | | | |
|---|---|---|---|---|---|---|---|---|---|---|
| F | 0.09 | 0.03 | 1.83 | 0.003 | 0.005 | 0.024 | 0.004 | 0.68 | 0.100 | 0.01 |
| G | 0.07 | 0.11 | 2.01 | 0.017 | 0.006 | 0.079 | 0.003 | 0.72 | 0.069 | |
| H | 0.10 | 0.05 | 2.23 | 0.026 | 0.002 | 0.042 | 0.002 | 0.45 | 0.124 | |
| I | 0.15 | 1.20 | 2.03 | 0.014 | 0.002 | 0.022 | 0.001 | 0.33 | 0.071 | |
| J | 0.13 | 0.63 | 2.08 | 0.009 | 0.004 | 0.029 | 0.004 | 0.66 | 0.121 | 0.08 |
| K | 0.11 | 0.19 | 1.63 | 0.015 | 0.006 | 0.018 | 0.006 | 0.44 | 0.098 | |
| L | 0.08 | 1.18 | 2.30 | 0.020 | 0.007 | 0.070 | 0.002 | 0.79 | 0.088 | |
| M | 0.12 | 1.00 | 2.13 | 0.008 | 0.003 | 0.019 | 0.004 | 0.60 | 0.101 | |
| N | 0.14 | 1.16 | 1.70 | 0.017 | 0.001 | 0.070 | 0.007 | 0.36 | 0.157 | |
| O | 0.09 | 0.51 | 2.20 | 0.004 | 0.004 | 0.034 | 0.005 | 0.34 | 0.131 | |
| P | 0.09 | 0.12 | 1.83 | 0.013 | 0.002 | 0.047 | 0.009 | 0.35 | 0.079 | |
| Q | 0.04 | 0.20 | 2.00 | 0.010 | 0.003 | 0.026 | 0.001 | 0.73 | 0.135 | |
| R | 0.11 | 0.08 | 1.93 | 0.007 | 0.005 | 0.040 | 0.003 | 0.77 | 0.206 | |
| S | 0.11 | 0.29 | 2.18 | 0.008 | 0.002 | 0.061 | 0.006 | 0.68 | 0.140 | 0.11 |
| T | 0.21 | 0.09 | 1.83 | 0.019 | 0.002 | 0.030 | 0.004 | 0.45 | 0.081 | |
| U | 0.12 | 0.60 | 1.99 | 0.016 | 0.004 | 0.047 | 0.003 | 0.33 | 0.054 | |
| V | 0.06 | 0.13 | 2.03 | 0.020 | 0.009 | 0.020 | 0.007 | 1.02 | 0.077 | |
| W | 0.13 | 0.46 | 1.46 | 0.010 | 0.003 | 0.043 | 0.001 | 0.39 | 0.108 | |
| X | 0.16 | 0.15 | 1.77 | 0.009 | 0.006 | 0.025 | 0.003 | 0.29 | 0.163 | |
| Y | 0.14 | 1.10 | 2.53 | 0.030 | 0.001 | 0.083 | 0.005 | 0.41 | 0.147 | |

| STEEL | CHEMICAL COMPOSITION (MASS %) | | | | | | | | |
|---|---|---|---|---|---|---|---|---|---|
| SYMBOL | V | B | Cu | Ni | Mo | W | Ca | Mg | REM |
| A | | | | | | | | | |
| B | | | | | | | 0.0018 | | |
| C | | 0.0015 | | | | | | | |
| D | | | 0.10 | 0.10 | | | | | |
| E | | | | | | | | | |
| F | | | | | | | | | |
| G | | 0.0029 | | | | | | | |
| H | 0.17 | | | | | | | | |
| I | | | | | | 0.20 | | | |
| J | | | | | | | | | |
| K | | | | | | | | | 0.005 |
| L | | | | | | | | | |
| M | | | | | | | | 0.0023 | |
| N | | | | | | | | | |
| O | | | | | 0.13 | | | | |
| P | | | | | | | | | |
| Q | | | | | | | | | |
| R | | | | | | | | | |
| S | | | | | | | | | |
| T | | | | | | | | | |
| U | | | | | | | | | |
| V | | | | | | | | | |
| W | | | | | | | | | |
| X | | | | | | | | | |
| Y | | | | | | | | | |

TABLE 2

| SAMPLE No. | STEEL SYMBOL | SLAB HEATING TEMPER-ATURE (° C.) | DELIVERY SIDE TEMPER-ATURE (° C.) | ELAPSED TIME (SEC) | AVERAGE COOLING RATE (° C./SEC) | COILING TEMPER-ATURE (° C.) | THICKNESS (mm) |
|---|---|---|---|---|---|---|---|
| 1 | A | 1185 | 845 | 1.2 | 35 | 570 | 5 |
| 2 | A | 1185 | 790 | 3.5 | 20 | 570 | 5 |
| 3 | B | 1195 | 905 | 1.1 | 60 | 555 | 10 |
| 4 | B | 1145 | 905 | 1.1 | 25 | 555 | 10 |
| 5 | C | 1240 | 900 | 1.2 | 50 | 595 | 2.3 |
| 6 | C | 1240 | 920 | 1.2 | 50 | 655 | 2.3 |
| 7 | D | 1235 | 915 | 1.2 | 65 | 570 | 6 |
| 8 | D | 1235 | 930 | 1.2 | 65 | 490 | 6 |
| 9 | E | 1165 | 895 | 1.3 | 45 | 590 | 10 |
| 10 | E | 1260 | 925 | 1.3 | 30 | 660 | 10 |
| 11 | F | 1205 | 915 | 1.2 | 50 | 555 | 6 |
| 12 | F | 1205 | 915 | 4 | 50 | 555 | 6 |
| 13 | F | 1205 | 915 | 1.2 | 50 | 500 | 6 |
| 14 | G | 1215 | 875 | 2.5 | 45 | 580 | 7 |
| 15 | H | 1230 | 850 | 1.2 | 40 | 575 | 2.6 |
| 16 | H | 1130 | 950 | 1.2 | 40 | 655 | 2.6 |
| 17 | I | 1175 | 840 | 2 | 35 | 570 | 8 |

TABLE 2-continued

| SAMPLE No. | STEEL SYMBOL | SLAB HEATING TEMPER-ATURE (° C.) | DELIVERY SIDE TEMPER-ATURE (° C.) | ELAPSED TIME (SEC) | AVERAGE COOLING RATE (° C./SEC) | COILING TEMPER-ATURE (° C.) | THICKNESS (mm) |
|---|---|---|---|---|---|---|---|
| 18 | I | 1265 | 935 | 2 | 35 | 480 | 8 |
| 19 | J | 1220 | 885 | 1.2 | 55 | 590 | 7 |
| 20 | J | 1140 | 885 | 1.2 | 55 | 650 | 7 |
| 21 | K | 1160 | 860 | 1.2 | 45 | 585 | 3.5 |
| 22 | K | 1125 | 860 | 1.2 | 45 | 495 | 3.5 |
| 23 | L | 1195 | 845 | 1.5 | 40 | 585 | 8 |
| 24 | L | 1195 | 845 | 1.5 | 40 | 650 | 8 |
| 25 | M | 1245 | 885 | 1.2 | 40 | 585 | 7 |
| 26 | M | 1255 | 940 | 4.5 | 20 | 585 | 7 |
| 27 | N | 1195 | 905 | 1.2 | 60 | 595 | 3.2 |
| 28 | N | 1195 | 925 | 1.2 | 60 | 595 | 3.2 |
| 29 | O | 1200 | 915 | 0.8 | 75 | 555 | 10 |
| 30 | O | 1125 | 800 | 0.8 | 75 | 555 | 10 |
| 31 | P | 1215 | 915 | 1.2 | 50 | 570 | 7 |
| 32 | Q | 1200 | 855 | 1.2 | 40 | 565 | 2.3 |
| 33 | R | 1225 | 900 | 1.2 | 65 | 570 | 9 |
| 34 | S | 1170 | 900 | 1.2 | 55 | 590 | 7 |
| 35 | T | 1190 | 910 | 1.2 | 45 | 590 | 10 |
| 36 | U | 1210 | 835 | 1.2 | 35 | 580 | 6 |
| 37 | V | 1245 | 910 | 1.2 | 55 | 555 | 3.5 |
| 38 | W | 1185 | 895 | 1.2 | 50 | 580 | 8 |
| 39 | X | 1235 | 850 | 1.2 | 50 | 590 | 2.9 |
| 40 | Y | 1210 | 840 | 1.2 | 45 | 575 | 10 |

Next, a sample for observation was taken from the steel sheet, and then, a ratio $R_{Ti}$ of an amount of Ti contained in Ti carbide of 100 nm or more and 1 μm or less in grain diameter to an effective Ti amount, a thickness of a scale, an average value Ave of Cr concentrations in a subscale, and a value Rd farthest from 1.00 among concentration ratios $R_{Cr}$ were measured. Results thereof are presented in Table 3. An underline in Table 3 indicates that the value deviates from the range of the present invention.

Further, a test piece for a tensile test was taken from the steel sheet, and yield strength and a yield ratio were measured by the tensile test. Further, a strip test piece for evaluation of scale adhesion was taken and the evaluation of the scale adhesion was carried out by the above-described method. Results thereof are also presented in Table 3. An underline in Table 3 indicates that the value deviates from a desirable range. The desirable range here is a range where the yield strength is 700 MPa or more and less than 800 MPa, the yield ratio is 85% or more, and the scale adhesion is good (○)

TABLE 3

| | | | SCALE | | | MECHANICAL PROPERTY | | | | |
|---|---|---|---|---|---|---|---|---|---|---|
| SAMPLE No. | STEEL SYMBOL | RATIO $R_{Ti}$ (%) | THICK-NESS (μm) | AVERAGE VALUE Ave (MASS %) | VALUE Rd (-) | YIELD STRENGTH (MP) | YIELD RATIO (%) | SCALE ADHESION | REMARKS | CLASSIFICATION |
| 1 | A | 23 | 5.5 | 2.32 | 0.65 | 704 | 90 | ○ | | INVENTION EXAMPLE |
| 2 | A | 39 | 4.0 | 2.30 | 1.10 | 680 | 78 | X | UNIFORMITY OF THICKNESS, ROLLING LOAD | COMPARATIVE EXAMPLE |
| 3 | B | 12 | 7.8 | 3.89 | 1.42 | 741 | 88 | ○ | | INVENTION EXAMPLE |
| 4 | B | 37 | 7.5 | 3.93 | 0.92 | 691 | 81 | X | | COMPARATIVE EXAMPLE |
| 5 | C | 15 | 9.0 | 3.20 | 1.13 | 725 | 93 | ○ | | INVENTION EXAMPLE |
| 6 | C | 32 | 10.8 | 5.14 | 1.22 | 704 | 84 | X | | COMPARATIVE EXAMPLE |
| 7 | D | 17 | 9.3 | 3.60 | 1.20 | 726 | 86 | ○ | | INVENTION EXAMPLE |
| 8 | D | 44 | 10.2 | 1.47 | 0.75 | 651 | 81 | X | | COMPARATIVE EXAMPLE |
| 9 | E | 4 | 8.1 | 2.60 | 1.42 | 776 | 91 | ○ | | INVENTION EXAMPLE |
| 10 | E | 36 | 12.6 | 5.39 | 0.93 | 697 | 84 | X | YIELD, FUEL COST | COMPARATIVE EXAMPLE |
| 11 | F | 19 | 7.2 | 4.39 | 0.76 | 718 | 88 | ○ | | INVENTION EXAMPLE |

TABLE 3-continued

| SAMPLE No. | STEEL SYMBOL | RATIO $R_{Ti}$ (%) | SCALE THICKNESS (μm) | SCALE AVERAGE VALUE Ave (MASS %) | SCALE AVERAGE VALUE Rd (-) | MECHANICAL PROPERTY YIELD STRENGTH (MP) | MECHANICAL PROPERTY YIELD RATIO (%) | SCALE ADHESION | REMARKS | CLASSIFICATION |
|---|---|---|---|---|---|---|---|---|---|---|
| 12 | F | 36 | 7.2 | 4.35 | 0.92 | 695 | 77 | X | | COMPARATIVE EXAMPLE |
| 13 | F | 38 | 7.1 | 1.38 | 1.34 | 670 | 79 | X | | COMPARATIVE EXAMPLE |
| 14 | G | 22 | 6.6 | 4.25 | 1.27 | 710 | 87 | ○ | | INVENTION EXAMPLE |
| 15 | H | 7 | 5.7 | 3.74 | 0.76 | 753 | 89 | ○ | | INVENTION EXAMPLE |
| 16 | H | 43 | 13.6 | 5.57 | 0.82 | 652 | 83 | X | | COMPARATIVE EXAMPLE |
| 17 | I | 11 | 4.8 | 1.98 | 0.88 | 745 | 86 | ○ | | INVENTION EXAMPLE |
| 18 | I | 31 | 10.1 | 1.43 | 0.86 | 700 | 82 | X | YIELD, FUEL COST | COMPARATIVE EXAMPLE |
| 19 | J | 8 | 8.0 | 3.81 | 1.31 | 781 | 89 | ○ | | INVENTION EXAMPLE |
| 20 | J | 36 | 8.5 | 5.92 | 1.27 | 690 | 81 | X | | COMPARATIVE EXAMPLE |
| 21 | K | 15 | 6.1 | 2.93 | 1.19 | 730 | 89 | ○ | | INVENTION EXAMPLE |
| 22 | K | 40 | 5.2 | 1.15 | 1.17 | 668 | 77 | X | | COMPARATIVE EXAMPLE |
| 23 | L | 14 | 6.9 | 4.91 | 1.16 | 734 | 88 | ○ | | INVENTION EXAMPLE |
| 24 | L | 16 | 7.0 | 5.52 | 0.79 | 730 | 87 | X | | COMPARATIVE EXAMPLE |
| 25 | M | 8 | 7.5 | 3.97 | 1.36 | 766 | 89 | ○ | | INVENTION EXAMPLE |
| 26 | M | 40 | 1.1 | 4.25 | 1.07 | 688 | 80 | X | YIELD, FUEL COST | COMPARATIVE EXAMPLE |
| 27 | N | 13 | 9.0 | 2.69 | 1.69 | 795 | 90 | ○ | | INVENTION EXAMPLE |
| 28 | N | 11 | 10.5 | 3.37 | 0.58 | 768 | 88 | X | | COMPARATIVE EXAMPLE |
| 29 | O | 11 | 7.6 | 2.02 | 0.55 | 740 | 90 | ○ | | INVENTION EXAMPLE |
| 30 | O | 35 | 4.4 | 1.88 | 1.80 | 678 | 81 | X | UNIFORMITY OF THICKNESS, ROLLING LOAD | COMPARATIVE EXAMPLE |
| 31 | P | 50 | 8.6 | 2.23 | 1.32 | 635 | 79 | ○ | | COMPARATIVE EXAMPLE |
| 32 | Q | 55 | 6.0 | 4.56 | 0.88 | 613 | 87 | ○ | | COMPARATIVE EXAMPLE |
| 33 | R | 39 | 7.9 | 4.90 | 1.33 | 695 | 82 | ○ | TOUGHNESS, WELDABILITY, DUCTILITY | COMPARATIVE EXAMPLE |
| 34 | S | 38 | 8.8 | 4.69 | 1.31 | 688 | 85 | ○ | TOUGHNESS, DUCTILITY | COMPARATIVE EXAMPLE |
| 35 | T | 5 | 9.6 | 4.00 | 0.72 | 836 | 88 | ○ | TOUGHNESS, WELDABILITY, DUCTILITY | COMPARATIVE EXAMPLE |
| 36 | U | 31 | 6.3 | 2.63 | 1.16 | 702 | 78 | ○ | | COMPARATIVE EXAMPLE |
| 37 | V | 24 | 7.1 | 6.80 | 0.89 | 705 | 86 | X | | COMPARATIVE EXAMPLE |
| 38 | W | 37 | 8.2 | 2.37 | 0.70 | 666 | 88 | ○ | | COMPARATIVE EXAMPLE |
| 39 | X | 8 | 7.0 | 1.45 | 0.84 | 798 | 92 | X | | COMPARATIVE EXAMPLE |
| 40 | Y | 4 | 5.3 | 3.00 | 1.31 | 866 | 91 | ○ | TOUGHNESS, WELDABILITY, DUCTILITY | COMPARATIVE EXAMPLE |

As presented in Table 3, in the samples No. 1, No. 3, No. 5, No. 7, No. 9, No. 11, No. 14, No. 15, No. 17, No. 19, No. 21, No. 23, No. 25, No. 27, and No. 29, which are in the range of the present invention, good mechanical properties and excellent scale adhesion could be obtained.

Meanwhile, in the samples No. 2, No. 4, No. 12, and No. 26, since the ratio $R_{Ti}$ was too high and the value Rd was too close to 1.00, the yield strength and the yield ratio were low, resulting in bad scale adhesion. In the sample No. 6, since the ratio $R_{Ti}$ was too high, the scale was too thick, and the average value Ave was too large, the yield ratio was low, resulting in bad scale adhesion. In the sample No. 8, since the ratio $R_{Ti}$ was too high, the scale was too thick, and the average value Ave was too small, the yield strength and the yield ratio were low, resulting in bad scale adhesion. In the sample No. 10, since the ratio $R_{Ti}$ was too high, the scale was too thick, the average value Ave was too large, and the value Rd was too close to 1.00, the yield strength and the yield ratio were low, resulting in bad scale adhesion. In the samples No. 13 and No. 22, since the ratio $R_{Ti}$ was too high and the average value Ave was too small, the yield strength and the yield ratio were low, resulting in bad scale adhesion. In the sample No. 16, since the ratio $R_{Ti}$ was too high, the scale was too thick, and the average value Ave was too large, the yield strength and the yield ratio were low, resulting in bad scale adhesion. In the sample No. 18, since the ratio $R_{Ti}$ was too high, the scale was too thick, and the average value Ave was too small, the yield ratio was low, resulting in bad scale adhesion. In the sample No. 20, since the ratio $R_{Ti}$ was too high and the average value Ave was too large, the yield strength and the yield ratio were low, resulting in bad scale adhesion. In the sample No. 24, since the average value Ave was too large, the scale adhesion was bad. In the sample No. 28, since the scale was too thick, the scale adhesion was bad. In the sample No. 30, since the ratio $R_{Ti}$ was too high, the yield strength and the yield ratio were low, resulting in bad scale adhesion.

In the sample No. 31, since the N content was too high and the ratio $R_{Ti}$ was too high, the yield strength and the yield ratio were low. In the sample No. 32, since the C content was too low and the ratio $R_{Ti}$ was too high, the yield strength was low. In the sample No. 33, since the Ti content was too high and the ratio $R_{Ti}$ was too high, the yield strength and the yield ratio were low. In the sample No. 34, since the Nb content was too high and the ratio $R_{Ti}$ was too high, the yield strength was low. In the sample No. 35, since the C content was too high, the yield strength was high. In the sample No. 36, since the Ti content was too low and the ratio $R_{Ti}$ was too high, the yield ratio was low. In the sample No. 37, since the Cr content was too high and the average value Ave was too large, the scale adhesion was bad. In the sample No. 38, since the Mn content was too low and the ratio $R_{Ti}$ was too high, the yield strength was low. In the sample No. 39, since the Cr content was too low and the average value Ave was too small, the scale adhesion was bad. In the sample No. 40, since the Mn content was too high, the yield strength was too high.

When focusing on a manufacturing condition, in the sample No. 2, since the delivery side temperature was too low, the rolling load was large, resulting in low uniformity of thicknesses. Further, the elapsed time was too long and the average cooling rate was too low. In the sample No. 4, the slab heating temperature was too low and the average cooling rate was too low. In the sample No. 6, the delivery side temperature was too high and a coiling temperature was too high. In a sample No. 8, the delivery side temperature was too high and the coiling temperature was too low. In the sample No. 10, since the slab heating temperature was too high, the yield was low and the fuel cost was high. Further, the delivery side temperature was too high, the average cooling rate was too low, and the coiling temperature was too high. In the sample No. 12, the elapsed time was too long. In the sample No. 13, the coiling temperature was too low. In the sample No. 16, the slab heating temperature was too low, the delivery side temperature was too high, and the coiling temperature was too high. In the sample No. 18, since the slab heating temperature was too high, the yield was low and the fuel cost was high. Further, the delivery side temperature was too high and the coiling temperature was too low. In the sample No. 20, the slab heating temperature was too low and the coiling temperature was too high. In the sample No. 22, the slab heating temperature was too low and the coiling temperature was too low. In the sample No. 24, the coiling temperature was too high. In the sample No. 26, since the slab heating temperature was too high, the yield was low and the fuel cost was high. Further, the delivery side temperature was too high, the elapsed time was too long, and the average cooling rate was too low. In the sample No. 28, the delivery side temperature was too high. In the sample No. 30, the slab heating temperature was too low and the delivery side temperature was too low.

Picklability was evaluated for the samples No. 1 to No. 30. The picklability was low in the samples, whose scale adhesion was excellent, i.e., No. 1, No. 3, No. 5, No. 7, No. 9, No. 11, No. 14, No. 15, No. 17, No. 19, No. 21, No. 23, No. 25, No. 27, and No. 29, and the picklability was high in the other samples. In other words, the scale was unlikely to be removed by pickling in the sample whose scale adhesion was excellent, and the scale was likely to be removed by pickling in the sample whose scale adhesion was low. In this evaluation, the steel sheet was immersed in hydrochloric acid of 80° C. in temperature and 10 mass % in concentration for 30 seconds, washed, dried, and thereafter adhesive tape was attached to the steel sheet. Then, the adhesive tape was peeled from the steel sheet and whether or not an adherent exists on the adhesion tape was visually observed. Existence of the adherent indicates that the scale remained also after immersion to hydrochloric acid, that is, that picklability is low, while absence of the adherent indicates that the scale was removed by immersion to hydrochloric acid, in other words, that the picklability is high.

INDUSTRIAL APPLICABILITY

The present invention may be used for an industry related to a steel sheet suitable for a member of a transportation machine such as an automobile or a railway vehicle, for example.

The invention claimed is:

1. A steel sheet comprising:

a base iron;

a scale of 10.0 μm or less in thickness on a surface of the base iron; and a subscale between the base iron and the scale, wherein the base iron comprises a chemical composition represented by, in mass %, C: 0.05% to 0.20%, Si: 0.01% to 1.50%, Mn: 1.50% to 2.50%, P: 0.05% or less, S: 0.03% or less, Al: 0.005% to 0.10%, N: 0.008% or less, Cr: 0.30% to 1.00%, Ti: 0.06% to 0.20%, Nb: 0.00% to 0.10%, V: 0.00% to 0.20%, B: 0.0000% to 0.0050%, Cu: 0.00% to 0.50%, Ni: 0.00% to 0.50%, Mo: 0.00% to 0.50%, W: 0.00% to 0.50%, Ca: 0.0000% to 0.0050%, Mg: 0.0000% to 0.0050%, REM: 0.000% to 0.010%, and the balance: Fe and impurities, wherein, in the base iron, a percentage of an amount of Ti contained in carbide or carbonitride of 100 nm or more and 1 μm or less in grain diameter to a parameter $Ti_{eff}$ represented by a following formula 1 is 30% or less, [Ti] denoting a Ti content (mass %) and [N] denoting a N content (mass %) in the following formula 1, wherein, in the subscale, an average value of Cr concentrations is 1.50 mass % to 5.00 mass %, wherein the average value of Cr concentrations is an average value Ave of maximum values Cmax among 50 or more measurement regions, each of the 50 or more measurement regions is made of 10 measurement points of Cr concentration continually lining up in a rolling direction, and an interval between the measurement points is 0.1 μm, and one part or more exist(s) where a ratio of one's maximum value Cmax to the other's maximum value Cmax is 0.90 or less or 1.11 or more between two adjacent measurement regions among the 50 or more measurement regions, $$T_{eff}=[Ti]-48/14[N] \quad \text{(formula 1).}$$

2. The steel sheet according to claim 1, wherein, in the chemical composition, Nb: 0.001% to 0.10%,
V: 0.001% to 0.20%,
B: 0.0001% to 0.0050%,
Cu: 0.01% to 0.50%,
Ni: 0.01% to 0.50%,
Mo: 0.01% to 0.50%, or
W: 0.01% to 0.50%,
or any combination of the above is satisfied.

3. The steel sheet according to claim 1, wherein, in the chemical composition, Ca: 0.0005% to 0.0050%,
Mg: 0.0005% to 0.0050%, or
REM: 0.0005% to 0.010%,
or any combination of the above is satisfied.

4. The steel sheet according to claim 2, wherein, in the chemical composition, Ca: 0.0005% to 0.0050%,
Mg: 0.0005% to 0.0050%, or
REM: 0.0005% to 0.010%,
or any combination of the above is satisfied.

* * * * *